US009234301B2

(12) United States Patent
Ikeda et al.

(10) Patent No.: US 9,234,301 B2
(45) Date of Patent: Jan. 12, 2016

(54) METHOD FOR WET SPINNING

(71) Applicant: MITSUBISHI RAYON CO., LTD., Chiyoda-ku (JP)

(72) Inventors: Katsuhiko Ikeda, Hatsukaichi (JP); Hiromasa Inada, Hatsukaichi (JP)

(73) Assignee: MITSUBISHI RAYON CO., LTD., Chiyoda-ku (JP)

( * ) Notice: Subject to any disclaimer, the term of this patent is extended or adjusted under 35 U.S.C. 154(b) by 266 days.

(21) Appl. No.: 13/946,466

(22) Filed: Jul. 19, 2013

(65) Prior Publication Data

US 2013/0300013 A1 Nov. 14, 2013

Related U.S. Application Data

(62) Division of application No. 12/988,203, filed as application No. PCT/JP2009/057761 on Apr. 17, 2009, now Pat. No. 8,529,237.

(30) Foreign Application Priority Data

Apr. 18, 2008 (JP) ..... 2008-108972

(51) Int. Cl.
*D01D 13/00* (2006.01)
*D01D 5/06* (2006.01)

(52) U.S. Cl.
CPC ..... *D01D 5/06* (2013.01)

(58) Field of Classification Search
CPC ..... D01D 5/06; D01D 13/00
USPC ..... 264/180, 184, 185
See application file for complete search history.

(56) References Cited

U.S. PATENT DOCUMENTS 2,793,396 A 5/1957 Dooley
2,908,937 A * 10/1959 Frans Hesselink ..... 264/180
6,248,267 B1 6/2001 Hosako et al.

FOREIGN PATENT DOCUMENTS

GB 784896 10/1957
GB 816687 7/1959

(Continued)

OTHER PUBLICATIONS

International Search Report issued Jun. 2, 2009 in PCT/JP2009/057761 filed Apr. 17, 2009.

(Continued)

*Primary Examiner* — Leo B Tentoni
(74) *Attorney, Agent, or Firm* — Oblon, McClelland, Maier & Neustadt, L.L.P.

(57) ABSTRACT

Disclosed are a wet spinning apparatus and a wet spinning method, which enable to manufacture fibers with excellent quality by controlling the flow of a coagulation liquid in a spinning bath and which enable to cope with high speed spinning (or high speed drawing). A wet spinning apparatus comprises a spinning bath at one end in which there are provided a nozzle for discharging a spinning raw liquid and coagulation liquid discharge ports and for discharging a coagulation liquid, at the other end in which there are provided a drawing roll for drawing coagulated filaments and a coagulation liquid recovery portion into which the coagulation liquid flows out. The spinning bath has a coagulation bath portion having a cross sectional area gradually reduced from one end to the other end, for coagulating the spinning raw liquid, and a filament running portion having a cross sectional area gradually enlarged from one end to the other end, for allowing the coagulated filaments to run therein.

1 Claim, 7 Drawing Sheets

(56) References Cited

FOREIGN PATENT DOCUMENTS

| | | |
|---|---|---|
| JP | 33-9012 | 10/1958 |
| JP | 41 18091 | 8/1966 |
| JP | 62 33814 | 2/1987 |
| JP | 9 67714 | 3/1997 |
| JP | 9 291413 | 11/1997 |
| JP | 11 229227 | 8/1999 |
| JP | 2006 336152 | 12/2006 |
| JP | 2006 342451 | 12/2006 |
| JP | 2008 202188 | 9/2008 |
| JP | 2008 202189 | 9/2008 |

OTHER PUBLICATIONS

Extended Search Report issued May 26, 2011 in European Patent Application No. 09732071.7-1217 / 2267198.
Japanese Office Action issued Nov. 1, 2011 in patent application No. 2009-519736 with English Translation.

* cited by examiner

METHOD FOR WET SPINNING

This application is a divisional application of application Ser. No. 12/988,203, filed Jan. 3, 2011, which is a National Stage of PCT/JP2009/057761, filed Apr. 17, 2009, and claims the benefit of priority to Japanese Application No. 2008-107972, filed Apr. 18, 2008, the entire contents of each are incorporated herein by reference.

TECHNICAL FIELD

The present invention relates to a wet spinning apparatus and a method for wet spinning.

BACKGROUND ART

A wet spinning apparatus is an apparatus for solidifying a spinning raw liquid prepared by dissolution of an organic polymer in a solvent into a fiber form by discharging the spinning raw liquid from a nozzle into a coagulation liquid. Acrylic fibers, polyvinyl fibers, and other acrylic based fibers can be produced by the wet spinning apparatus.

The wet spinning apparatus is generally equipped with a spinning bath in which a coagulation liquid is contained, a nozzle immersed at one end in the spinning bath, and a drawing roll immersed at the other end in the spinning bath, wherein a spinning raw liquid discharged from the nozzle is coagulated by the coagulation liquid and thus formed into coagulated filaments which are then drawn out of the spinning bath through the drawing roll. The coagulation liquid is discharged into the spinning bath from a coagulation liquid discharge port disposed on the rear surface side of the nozzle, and is caused to flow to a running direction of the coagulated filaments while coagulating the coagulated filaments, and is caused to flow out into a coagulation liquid recovery portion from a spinning bath outlet port disposed at the other end in the spinning bath. Fibers (coagulated filaments) solidified in the spinning bath are separated from the coagulation liquid, washed, and transferred to the subsequent steps such as chemical liquid treatment, drying, and thermal treatment.

The speed of spinning and drawing of the coagulated filaments is generally set faster than the average flow rate of the coagulation liquid to be supplied into the spinning bath. As a result, the coagulation liquid flowing in the vicinity of the coagulated filaments is attracted by and accompanies the coagulated filaments, and is caused to flow to the direction of drawing with a velocity near a spinning speed (hereinafter, this is referred to as "accompanying flow"). At the same time, there occurs a phenomenon such that the coagulation liquid flows backward from the downstream side to the upstream side to compensate the accompanying flow at a place near the bottom wall or the sidewall which is distant from the coagulated filaments in the spinning bath. In this way, there have been simultaneously and adjacently generated two flows contrary to each other, namely the accompanying flow and the counter flow, in the spinning bath, so that the flows have interfered each other to cause irregular flow of the coagulation liquid and thus there have been partially generated whirlpools and stagnation.

When such whirlpools and stagnation were generated in the spinning bath, there was a case where filament waste (nest) derived from break of a single fiber caused by poor coagulation of the spinning raw liquid floated in the spinning bath and lumps of the filament waste came into contact with the coagulated filaments and thereby deterioration of quality and performance of the product was caused. In addition, when the spinning speed was raised to improve productivity, stable production was disturbed because turbulent flow of the coagulation liquid became more remarkable and the coagulated filaments were shaken and thus diameter-unevenness or break of a single fiber was generated.

Therefore, the following wet spinning apparatus has been proposed to solve the above-mentioned problem.

A wet spinning apparatus equipped with rectifying plates provided on both sides of the coagulated filaments along with the running direction of the coagulated filaments (for example, Patent Document 1). As for this wet spinning apparatus, turbulence of the flow of the coagulation liquid can be suppressed by the rectifying plates.

However, as for such a wet spinning apparatus, there was a case where the flow rate of the coagulation liquid at a part where the coagulation liquid flowed out from the spinning bath became too fast and thus turbulence of the coagulated filaments (tow) was caused.

Accordingly, there has been proposed a wet spinning apparatus in which a coagulation liquid-partitioning plates (rectifying plates) for partitioning the coagulation liquid are provided between the coagulated filaments and walls of the spinning bath standing in parallel with the running direction of the coagulated filaments, and holes (openings) for drawing out coagulation liquid are formed on the coagulation liquid-partitioning plates (for example, Patent Documents 2 to 4). As for this wet spinning apparatus, the inside of the spinning bath is separated into an inner bath which is located inside the coagulation liquid-partitioning plates and in which the coagulated filaments are running, and outer baths located on both sides of the inner bath; the accompanying flow generated in the spinning bath is allowed to flow inside the inner bath toward downstream side, and the counter flow is allowed to flow inside the outer baths toward upstream side. In addition, it is possible to restrain the flow rate of the coagulation liquid from being too fast by causing the coagulation liquid to flow out from the inner bath to the outer baths through the openings.

Patent Document 1: Japanese Patent Application Laid-Open No. Sho 62-33,814

Patent Document 2: Japanese Patent Application Laid-Open No. Hei 9-67,714

Patent Document 3: Japanese Examined Utility Model Publication No. Sho 41-18,091

Patent Document 4: Japanese Patent Application Laid-Open No. Hei 11-229,227

DISCLOSURE OF INVENTION

Problem to be Solved by the Invention

However, as for the wet spinning apparatuses in Patent Document 2 or 3, there was a case where nest generated from the coagulated filaments clogged the openings provided on the rectifying plates and the nest re-sticked to the coagulated filaments and thereby quality and performance of the product were deteriorated.

In addition, as for the wet spinning apparatuses in Patent Document 1, 2 or 4, the generated counter flow was returned from outside of the rectifying plates to the vicinity of the nozzle so as to be mixed with a newly supplied coagulation liquid. Therefore, there was a case where there was generated turbulent flow of the coagulation liquid or unevenness in concentration or temperature of the coagulation liquid and thus break of a single fiber of the coagulated filaments was caused.

For these reasons, a wet spinning apparatus which can produce synthetic fibers excellent in quality and performance by control of the flow of the coagulation liquid in the spinning bath has been desired.

Therefore, objects of the present invention are to provide a wet spinning apparatus and a method for wet spinning, which enable to manufacture fibers with excellent quality and which also enable to cope with high speed spinning (or high speed drawing) by controlling the flow of a coagulation liquid in a spinning bath and thus by homogenizing concentration and temperature of the coagulation liquid in the spinning bath, and by suppressing break of a single fiber generated by turbulent flow of the coagulation liquid and suppressing formation of floating filament waste (nest) generated by stagnation.

Means for Solving the Problem

The wet spinning apparatus of the present invention is the one for spinning by coagulation of a spinning raw liquid to form coagulated filaments, which comprises a spinning bath, storing a coagulation liquid, having a coagulation bath portion for coagulating the spinning raw liquid and a filament running portion for allowing the coagulated filaments to run therein, the coagulation bath portion having a cross sectional area gradually reduced from one end to the other end, the filament running portion having a cross sectional area gradually enlarged from one end to the other end.

In addition, the method for wet spinning of the present invention comprises carrying out spinning for synthetic fibers by use of the aforementioned wet spinning apparatus while allowing flow rate (V) (m/min) of the coagulation liquid at the joint portion to fall in the range of from 0.5 to 1.5 times as much as drawing speed (v) (m/min) of a running filament tow.

Effect of the Invention

According to the wet spinning apparatus of the present invention, it is possible to manufacture fibers with excellent quality by controlling the flow of a coagulation liquid in a spinning bath and thus by homogenizing concentration and temperature of the coagulation liquid in the spinning bath, and by suppressing break of a single fiber generated by turbulent flow of the coagulation liquid and suppressing formation of floating filament waste (nest) generated by stagnation. In addition, it is possible to cope with high speed spinning (or high speed drawing) because the flow of the coagulation liquid can be made homogeneous.

In addition, according to the wet spinning apparatus of the present invention, fibers with excellent quality, namely, fibers with suppressed break of a single fiber and suppressed sticking of filament waste (nest), can be obtained. Further, the wet spinning apparatus enables to cope with high speed spinning (or high speed drawing) and thus can produce fibers in a high productivity.

EXPLANATION OF NUMERALS

Figure 1:
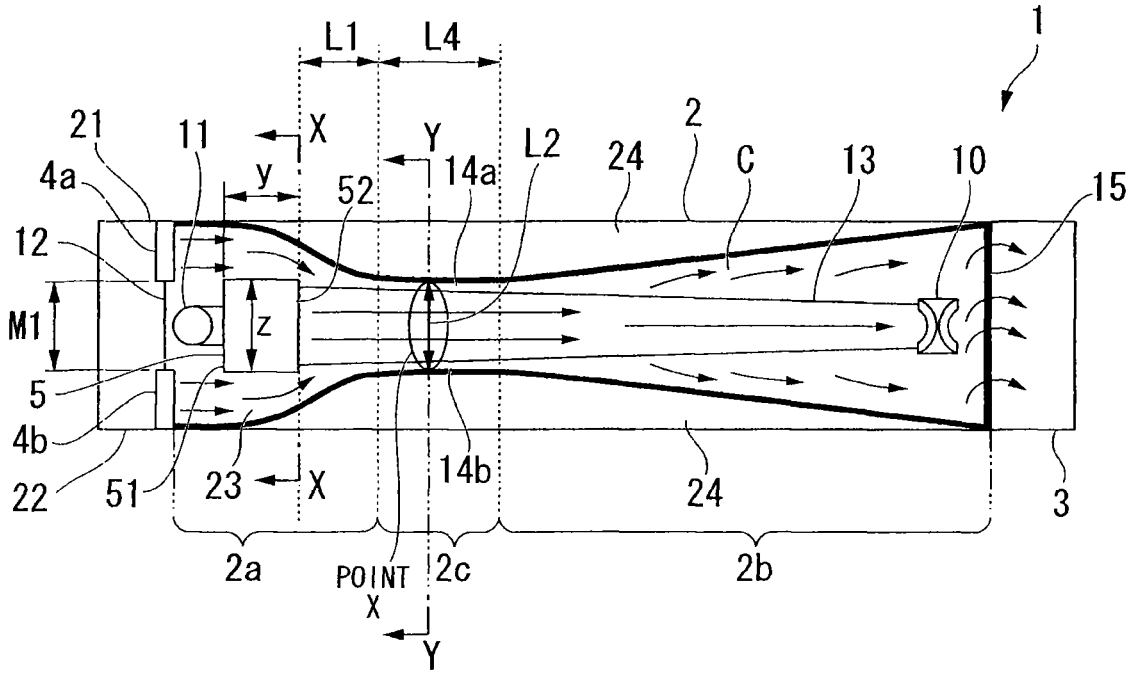
FIG. 1: A schematic plan view showing an outline constitution of one embodiment of the wet spinning apparatus of the present invention.

1: A wet spinning apparatus
2: A spinning bath
2*a*: A coagulation bath portion
2*b*: A filament running portion
2*c*: A joint portion
3: A coagulation liquid recovery portion
4*a*, 4*b*: Coagulation liquid discharge ports
5: A nozzle
10: A drawing roll
13: Coagulated filaments
14*a*, 14*b*: Rectifying plates
51: A rear surface of the nozzle
C: A coagulation liquid
S1: The maximum cross sectional area in the coagulation bath portion
S2: A cross sectional area at the joint portion
S3: The maximum cross sectional area in the filament running portion

BEST MODE FOR CARRYING OUT INVENTION

Wet Spinning Apparatus

An embodiment of the wet spinning apparatus of the present invention will be explained in detail based on FIGS. 1 to 5.

Figure 2A:
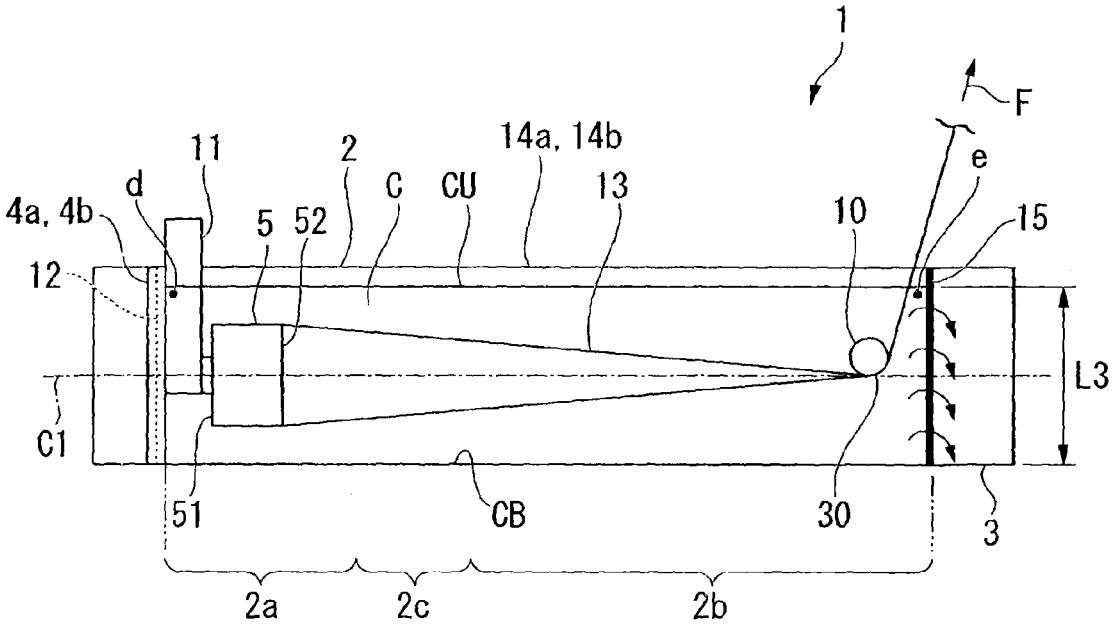
FIG. 2A: A schematic side view of the wet spinning apparatus of FIG. 1.

The wet spinning apparatus (1) has, as shown in FIG. 1, the spinning bath (2) storing the coagulation liquid (C), and the coagulation liquid recovery portion (3) which is disposed on the downstream side (on the right side in FIG. 1) of the spinning bath (2) and recovers the coagulation liquid (C) allowed to flow out of the spinning bath (2). The spinning bath (2) has the coagulation bath portion (2*a*) for coagulating the spinning raw liquid to form the coagulated filaments (13), the filament running portion (2*b*) for allowing the coagulated filaments to run therein, and the joint portion (2*c*) between the coagulation bath portion (2*a*) and the filament running portion (2*b*). In addition, the spinning bath (2) is built up in such a way that a liquid surface (CU) of the coagulation liquid (C) and a bottom level (CB) of the spinning bath (2) become roughly parallel to each other as shown in FIG. 2A.

At one end of the spinning bath (2) (an end on the upstream side), there are provided a nozzle (5) for discharging the spinning raw liquid toward the other end (an end on the downstream side) and the two coagulation liquid discharge ports (4*a*) and (4*b*) for discharging the coagulation liquid (C) from the upstream side of the nozzle (5) (FIG. 1).

The nozzle (5) is not particularly limited as long as it can discharge the spinning raw liquid into the coagulation liquid (C) in the spinning bath (2), and for example, a cylindrical shape nozzle can be recited.

A spinning raw liquid supply pipe (11) is connected at the rear surface (51) of the nozzle (5) (a surface on the upstream side; hereinafter, referred to as a nozzle rear surface (51)). Thus, the spinning raw liquid is passed from the spinning raw liquid supply pipe (11) through the nozzle rear surface (51) to the nozzle (5).

A spinneret (52) is provided at a surface for discharging (a surface on the downstream side) of the nozzle (5). The spinneret (52) is provided with a lot of fine pores for discharging (not shown in the figure) on its surface, for discharging the spinning raw liquid which is coagulated in the spinning bath (2) to form the coagulated filaments (13) (fibers). The shape and number of the fine pores for discharging are not particularly limited and can be selected in accordance with a production of a target synthetic fiber.

In addition, a distance (L3) (liquid depth) between the liquid surface (CU) of the spinning bath (2) and the bottom level (CB) of the spinning bath (2) is preferably in the range of from 1.2 to 2 times as much as a nozzle height (z) (mm).

L3: liquid depth (mm), z: nozzle height (mm)

When the liquid depth (L3) is 1.2 times as much as (z) or more, the coagulation liquid (c) is sufficiently supplied to the vicinity of the surface for discharging of the nozzle (5) and thus it becomes easy to suppress turbulent flow or stagnation of the coagulation liquid (C) in the vicinity of the nozzle (5). Especially, it becomes easy to suppress turbulent flow which is caused by whirlpools generated from insufficient supply of the coagulation liquid and is liable to occur at the liquid surface (CU) near the upper part of the nozzle (5).

When the liquid depth (L3) is 2 times as much as (z) or less, it is easy to avoid occurrence of stagnation of the coagulation liquid (C) at a position apart from the coagulated filaments (13) and hence to avoid floating of filament waste (nest) originated from break of a single fiber generated at the liquid surface (CU) near the upper part of the nozzle (5), so that it becomes easy to operate subsequent steps of washing and stretching stably. The liquid depth (L3) is preferably within the aforementioned range from the viewpoint of a preferable effect for preventing the counter flow of the coagulation liquid (C).

The coagulation liquid discharge ports (4*a*) and (4*b*) are disposed on the upstream side of the nozzle (5) in such a way that the direction of the coagulation liquid (C) to be discharged from each port is roughly parallel to the running direction of the coagulated filaments (13). There are provided a lot of fine pores for discharging (not shown in the figure) on the surfaces of the coagulation liquid discharge ports (4*a*) and (4*b*) facing to the nozzle (5), for discharging the coagulation liquid (C) therefrom toward the downstream side.

In addition, the coagulation liquid discharge ports (4*a*) and (4*b*) are disposed with a space in such a way that the width of the space between the coagulation liquid discharge port (4*a*) and the coagulation liquid discharge port (4*b*) (FIG. 1) becomes roughly equal to the width of the nozzle (5). Therefore, it can be suppressed that the flows of the coagulation liquid (C) discharged from the coagulation liquid discharge ports (4*a*) and (4*b*) hit the rear surface of the nozzle (5) (nozzle rear surface (51)) and thus cause turbulence of the flow of the coagulation liquid (C) surrounding the coagulated filaments (13) right after discharged from the nozzle (5).

In addition, in the present embodiment, the coagulation liquid discharge port (4*a*) is disposed in contact with a spinning bath side board (21) forming a side surface along with the lengthwise direction of the spinning bath (2), and the coagulation liquid discharge port (4*b*) is disposed in contact with another spinning bath side board (22) forming a side surface along with the lengthwise direction of the spinning bath (2). In addition, a subsidiary plate (12) is provided between the coagulation liquid discharge port (4*a*) and the coagulation liquid discharge port (4*b*). The subsidiary plate (12) does not have fine pores for discharging the coagulation liquid (C).

In this way, a bath wall in the widthwise direction on the upstream side of the spinning bath (2) is formed by the coagulation liquid discharge ports (4*a*) and (4*b*) and the subsidiary plate (12), and thus the coagulation liquid (C) can be stored inside the spinning bath (2).

A drawing roll (10) for drawing the coagulated filaments (13) from the spinning bath (2) is disposed at the other end of the spinning bath (2), and a spinning bath outlet port (15) is disposed on the down stream side thereof. The shape of the drawing roll (10) is not crucial as long as the drawing roll can draw the coagulated filaments (13) out of the spinning bath (2), and for example, a roller shape shown in FIG. 2A can be recited.

The nozzle (5) and the drawing roll (10) are disposed in such a way that the center of the surface for discharging of the nozzle (5) and the position of a portion (30) where the drawing roll first comes into contact with the coagulated filaments become the center position in the top-bottom direction of the liquid depth of the spinning bath (2) (FIG. 2A). Accordingly, drawing tension of the coagulated filaments (13) imposed on the surface for discharging of the nozzle (5) can be made uniform from the center part of the coagulated filaments (13) to the periphery part thereof and hence break of a single fiber caused by excessive drawing tension locally generated can be reduced to the utmost extent. Accordingly, an effect such that homogeneous coagulation of the coagulated filaments (13) tends to be realized can also be obtained.

The spinning raw liquid is coagulated by the coagulation liquid (C) right after discharged into the spinning bath (2) and becomes the coagulated filaments (13) which is further transferred to the downstream side. At this time, the coagulated filaments (13) runs from the upstream side to the downstream side in a wet spinning apparatus (1) along a center axis (C1). The center axis (C1) is an axis which runs through the center of the surface for discharging of the nozzle (5) and through the center position in the top-bottom direction of the liquid depth of the spinning bath (2) and is parallel to the liquid surface (CU) and the bottom level (CB) in the lengthwise direction of the spinning bath (2).

Then, the coagulated filaments (13) is allowed to change their direction toward an arrow (F) at the portion (30) of the drawing roll (10) located on the center axis (C1) while being rolled up, and is drawn by a drawing apparatus (not shown in the figure) disposed outside the wet spinning apparatus (1).

In addition, the spinning bath (2) is equipped with the two rectifying plates (14*a*) and (14*b*) formed from one end to the other end in the spinning bath (2). In the present embodiment, the spinning bath (2) is separated into an inner bath (23) in which the coagulated filaments (13) runs and two outer baths (24) which are formed on both sides of the inner bath (23).

The rectifying plate (14*a*) is formed in such a way that one end thereof contacts with a part near a contact section of the spinning bath side board (21) and the coagulation liquid discharge port (4*a*) and the other end thereof contacts with the spinning bath outlet port (15). The rectifying plate (14*b*) is also formed in such a way that one end thereof contacts with a part near a contact section of the spinning bath side board (22) and the coagulation liquid discharge port (4*b*) and the other end thereof contacts with the spinning bath outlet port (15).

The rectifying plates (14*a*) and (14*b*) are formed in such a way that a cross sectional area between the rectifying plates (14*a*) and (14*b*) is gradually reduced from one end (upstream side) to the other end (downstream side) at first, and then gradually enlarged. The cross sectional area in the present invention means a cross sectional area of a portion filled with the coagulation liquid in a cross sectional area of the spinning bath (2).

As for a coagulation bath length of the nozzle (5) (L1; a distance between the spinneret (52) and a contact point of the spinneret (52) with the joint portion) to be soaked in the coagulation bath portion, when the coagulation bath length (L1) is short, gaps between the nozzle (5) and the rectifying plates become narrow and thus the flow rate of the coagulation liquid becomes not less than the drawing speed of the coagulated filaments, so that break of a single fiber caused by turbulent flow of the coagulation liquid or a coagulation liquid flow are generated, and when the coagulation bath length (L1) is long, the gaps between the nozzle (5) and the rectifying plates become wide and thus the expected rectifying effect of the rectifying plate cannot be obtained.

Therefore, the optimum coagulation bath length (L1) can be suitably selected depending on the size of the nozzle (5), the production capacity, and the drawing speed so that it is possible to control the liquid flow of the coagulation liquid (C) discharged from the coagulation liquid discharge ports (4*a*) and (4*b*) and the liquid flow of the coagulation liquid (C) which is attracted by and accompanies the coagulated filaments generated at the nozzle surface. Accordingly, replacement efficiency of the coagulation liquid at the nozzle surface becomes good and homogeneous coagulation can be realized.

A width (L2) at the joint portion to be formed by a space between the rectifying plates (14*a*) and (14*b*) is preferably made as small as possible to the extent that they do not come into contact with the coagulated filaments (13) running. The width (L2) at the joint portion is preferably set the same as or slightly wider than the width of the coagulated filaments (13) running. When the width (L2) at the joint portion is narrower than the width of the coagulated filaments (13) running, the coagulated filaments are damaged by contact with the rectifying plates, which may cause break of a single fiber, and when the width (L2) at the joint portion is wider than the width of the coagulated filaments (13) running, counter flow or stagnation is generated between the coagulated filaments (13) and the rectifying plates and thus this is not preferable.

A length (L4) at the joint portion to be formed by a space between the rectifying plates (14*a*) and (14*b*) is preferably 40 to 160 mm. When the length (L4) at the joint portion is within this range, it is possible to prevent counter flow or stagnation at the joint portion. The length (L4) at the joint portion can be suitably set in this range by production capacity or the drawing speed.

When a ratio of a maximum value (S1) of the cross sectional area of the coagulation bath portion to a cross sectional area (S2) at the joint portion, namely (S1/S2), is from 1.5 to 5, it is easy to prevent a situation where the coagulation liquid (C) flows backward to the vicinity of the nozzle (5) and this causes turbulent flow in the whole area in the flow of the coagulation liquid (C) or causes increase in resistance in the coagulation liquid in the spinning bath (2). When a ratio of a maximum value (S3) of the cross sectional area of the filament running portion to a cross sectional area (S2) at the joint portion, namely (S3/S2), is from 1.5 to 5.5, it is possible to prevent the situation where the coagulation liquid after used for coagulation is returned to the vicinity of the nozzle (5) as a return flow and this causes whirlpools and stagnation, and further it is possible to prevent deterioration of quality and performance of the product caused by re-sticking of break of a single fiber generated from the nozzle (5) or re-sticking of floating filament waste (nest) generated by stagnation. Note that in the case where a cross sectional area at the joint portion changes, the minimum value of the cross sectional area is taken as the cross sectional area (S2) at the joint portion.

In other words, the coagulation liquid (C) is entirely flowed from outlet pores to the coagulation liquid recovery portion (3) without being returned to the vicinity of the nozzle (5) as a return flow as opposed to the case of a conventional wet spinning apparatus, while flowing from the upstream side to the downstream side in the spinning bath (2) with its flow increasingly widened in a direction perpendicular to a running direction of the coagulated filaments (13) without causing counter flow or stagnation.

In addition, surfaces of the rectifying plates (14*a*) and (14*b*) facing to the coagulated filaments (13) are preferably made as smooth as possible without any projections so as to prevent break of a single fiber which may be caused if the coagulated filaments (13) should come into contact with any of the rectifying plates (14*a*) and (14*b*). In addition, it is more preferable that stainless steel plates applied with hard chromium plating be used for the rectifying plates (14*a*) and (14*b*) or the rectifying plates (14*a*) and (14*b*) be coated with a material having a small coefficient of static friction such as fluorocarbon resin.

The height of the rectifying plates (14*a*) and (14*b*) is made higher than the liquid surface (CU) of the coagulation liquid of the spinning bath (2).

The rectifying plates (14*a*) and (14*b*) are plates having no openings. If the rectifying plate has openings, break of a single fiber generated from the nozzle or floating filament waste (nest) generated by stagnation may clog the openings, which makes stable production difficult, or the nest may re-stick to the coagulated filaments (13), which deteriorates quality and performance of the product.

Figure 5:
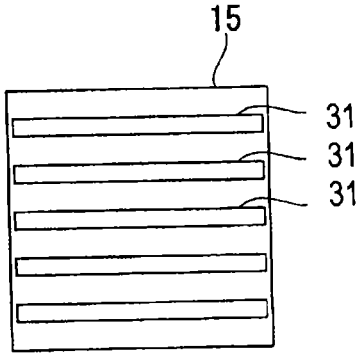
FIG. 5: A schematic view showing the spinning bath outlet port disposed on the other end in the spinning bath of the wet spinning apparatus of FIG. 1.

As an example of a method for discharging the coagulation liquid from the spinning bath outlet port (15) to the outside of the system, a method of discharging the coagulation liquid (C) roughly homogeneously from the entire spinning bath outlet port (15) through a plate for discharging provided with a plurality of outlet pores (31), each having a horizontal rectangular shape, formed uniformly in the top-bottom direction as shown in FIG. 5), or a method of discharging the coagulation liquid (C) by means of overflow from the upper part of the spinning bath can be recited. In the latter case, it is necessary to provide an inclined plate so as to prevent counter flow or stagnation of the coagulation liquid in the vicinity of the spinning bath outlet port (15) (refer to FIG. 2B).

(Method for Wet Spinning)

Hereinafter, a method for wet spinning of a synthetic fiber will be explained by use of the wet spinning apparatus (1) of the present embodiment.

At first, the spinning raw liquid is supplied from a spinning raw liquid supply device (not shown in the figure) to the spinning raw liquid supply pipe (11), and the aforementioned spinning raw liquid is transferred from the spinning raw liquid supply pipe (11) through the nozzle rear surface (51) to the nozzle (5) (FIG. 2A). Then, the spinning raw liquid is discharged from the spinneret (52) on the surface for discharging of the nozzle (5) into the coagulation liquid (C) and coagulated in the coagulation bath portion (2*a*), and the coagulated filaments (13) is formed.

The coagulated filaments (13) coagulated in the coagulation bath portion (2*a*) is allowed to run in the filament running portion (2*b*), allowed to change its direction by the drawing roll (10) immersed at the other end in the filament running portion (2*b*), transferred to the outside of the wet spinning apparatus (1), drawn by the a drawing apparatus (not shown in the figure), and transferred to the subsequent steps of washing and stretching.

The coagulation liquid (C) is discharged from a lot of fine pores for discharging (not shown in the figure) on the surfaces on the nozzle (5) side of the coagulation liquid discharge ports (4*a*) and (4*b*) in roughly parallel to the running direction of the coagulated filaments (13) toward the downstream side of the spinning bath (2). Accordingly, a liquid resistance between the coagulated filaments (13) and the coagulation liquid (C) can be made as small as possible, and thus more homogeneous coagulation can be carried out by suppression of fluctuation in running of the coagulated filament (13) caused by turbulence of the flow of the coagulation liquid (C).

A discharge quantity of the coagulation liquid (C) is preferably such an amount as it is possible to allow flow rate (V) (m/min) of the coagulation liquid at the joint portion (FIG. 1: point (X)) to fall in the range of from 0.5 to 1.5 times as much as drawing speed (v) (m/min) of a running filament tow, and the coagulation liquid (C) is preferably caused to flow out into the aforementioned coagulation liquid recovery portion.

V: flow rate at a point X (m/min)

v: drawing speed (m/min)

Point X: a point at the joint portion

When flow rate (V) (m/min) at the point (X) (FIG. 1) is 0.5 times as much as drawing speed (v) (m/min) of a running filament tow or more, it is easy to prevent a situation where the coagulation liquid (C) flows backward to the vicinity of the nozzle (5) and this causes turbulent flow in the whole area in the flow of the coagulation liquid (C) or causes increase in resistance in the coagulation liquid in the spinning bath (2), and when flow rate (V) (m/min) at the point (X) is 1.5 times as much as drawing speed (v) (m/min) of a running filament tow or less, it is easy to prevent a situation where the balance between the drawing speed of the coagulated filaments (13) running and the flow rate of the accompanying flow of the coagulation liquid (C) collapses and thus turbulent flow is generated in the flow of the coagulation liquid (C) and this generates adherence of the coagulated filaments (13) or break of a single fiber.

Each arrow without a mark in FIG. 1 shows a convection current direction of the coagulation liquid (C). The coagulation liquid (C) to be discharged from the coagulation liquid discharge ports (4*a*) and (4*b*) is caused to flow from the upstream side to the downstream side in the spinning bath (2) by the accompanying flow to be generated when the coagulated filaments (13) are allowed to run while drawn by the drawing apparatus (not shown in the figure).

The coagulation liquid (C) in the coagulation bath portion (2*a*) is supplied to the vicinity of the nozzle (5) without generating turbulent flow because the cross sectional area of the coagulation bath portion (2*a*) is gradually reduced from one end to the other end by the rectifying plates (14*a*) and (14*b*).

The coagulation liquid (C) supplied to the vicinity of the nozzle (5) is absorbed roughly homogeneously in the coagulated filaments (13) and then gradually squeezed out from the coagulated filaments (13) into the spinning bath (2) as the coagulated filaments (13) are allowed to run toward the drawing roll (10).

The coagulation liquid (C) squeezed out from the coagulated filaments (13) and the accompanying flow of the coagulation liquid (C) generated by the running of the coagulated filaments (13) in the filament running portion (2*b*) flow to the spinning bath outlet port (15) without generating turbulent flow while increasingly widened in the widthwise direction of the spinning bath (2) as the cross sectional area of the filament running portion (2*b*) is gradually enlarged from one end to the other end by the rectifying plates (14*a*) and (14*b*). Then, at the spinning bath outlet port (15), the coagulation liquid (C) is flowed out roughly homogeneously from a plurality of outlet pores (31) to the coagulation liquid recovery portion (3).

In other words, the coagulation liquid (C) discharged from the coagulation liquid discharge ports (4*a*) and (4*b*) is entirely flowed out from the outlet pores (31) to the coagulation liquid recovery portion (3) after used for coagulation without being returned to the vicinity of the nozzle (5) as a return flow as oppose to the case of a conventional wet spinning apparatus. During this period, the coagulation liquid (C) flows from the upstream side to the downstream side in the spinning bath (2) without causing counter flow or stagnation while increasingly widened in a direction perpendicular to a running direction of the coagulated filaments (13).

The coagulation liquid (C) flowed out from the coagulation liquid recovery portion (3) to the outside of the wet spinning apparatus (1) is recovered in a recovery tank (not shown in the figure), then adjusted to have a coagulation liquid concentration suitable for a spinning condition by addition of DI (deionized) water, and circulated to the coagulation liquid discharge ports (4*a*) and (4*b*) again by a pump (not shown in the figure).

As mentioned above, according to the wet spinning apparatus and the method for wet spinning of the present invention, it is possible to manufacture fibers with excellent quality by controlling the flow of a coagulation liquid in a spinning bath and thus by homogenizing concentration and temperature of the coagulation liquid in the spinning bath, and by suppressing break of a single fiber generated by turbulent flow of the coagulation liquid and suppressing formation of floating filament waste (nest) generated by stagnation. In addition, it is possible to cope with high speed spinning (or high speed drawing) because the flow of the coagulation liquid can be made homogeneous.

As a main cause of the above effect, it is thought that the spinning bath (2) has the coagulation bath portion (2*a*) in which the cross sectional area is gradually reduced from one end to the other end and the filament running portion (2*b*) in which the cross sectional area is gradually enlarged from one end to the other end. Accordingly, in the filament running portion (2*b*), counter flow or stagnation caused by the accompanying flow can be suppressed because the coagulation liquid (C) flows toward the downstream side while increasingly widened in the widthwise direction of the spinning bath (2); it can also be suppressed that the flow rate of the coagulation liquid (C) at the other end becomes too fast and that this rate thus causes turbulence of the tow (the coagulated filaments); further, the flow rate of the coagulation liquid (C) in the joint portion is faster than the flow rate of the coagulation liquid (C) in the filament running portion, so that the coagulation liquid (C) flowing through the joint portion (2*c*) toward the downstream side in the filament running portion (2*b*) can be prevented from forming a counter flow toward coagulation bath portion (2*a*). In addition, it is possible to suppress counter flow or stagnation without returning the coagulation liquid (C) to the vicinity of the nozzle (5) as a return flow as opposed to the case of a conventional wet spinning apparatus, so that it is possible to suppress unevenness in concentration and temperature of the coagulation liquid (C) in the vicinity of the nozzle (5), and it is also possible to improve replacement efficiency of the coagulation liquid.

In addition, the wet spinning apparatus of the present invention does not need rectifying plates with openings, so that it is possible to prevent the case where filament waste (nest) gets caught at the openings and thus sticks to the coagulated filaments.

In addition, it is preferable that the coagulation liquid discharge ports (4*a*) and (4*b*) be disposed so that the coagulation liquid (C) discharged do not hit the nozzle rear surface (51). Accordingly, a liquid resistance between the coagulated filaments (13) and the coagulation liquid (C) can be made as small as possible, and thus fluctuation in running of the coagulated filaments (13) caused by turbulence of the flow of the coagulation liquid (C) can be prevented.

The coagulation process right after the spinning raw liquid has been discharged considerably affects quality and performance of the fibers to be spun, and hence adherence of fibers, break of a single fiber, and generation of diameter-unevenness or unusual fibers can be suppressed by strenuous suppression of turbulent flow.

In addition, the wet spinning apparatus of the present invention can easily control the flow of the coagulation liquid (C) homogeneously in a fixed direction from the upstream side to the downstream side by changing the shape of the rectifying plates (14*a*) and (14*b*) and thus by adjusting the length and width of the coagulation bath portion (2*a*) and the filament running portion (2*b*) even when the spinning speed is raised for improvement of productivity and thus the accompanying flow is increased. Therefore, fibers with excellent quality can be stably produced even in the case of high speed spinning (or high speed drawing).

In addition, according to the method for wet spinning of the present invention, fibers with excellent quality, with suppressed break of a single fiber or sticking of filament waste (nest), can be obtained by use of the aforementioned wet spinning apparatus. In addition, fibers can be produced in a high productivity because the method can cope with high speed spinning (or high speed drawing).

It is assumed that this is because, besides the aforementioned effect of the wet spinning apparatus, counter flow or stagnation of the coagulation liquid can be effectively suppressed by discharge of the coagulation liquid in such a way that flow rate (V) (m/min) of the coagulation liquid at the joint portion (FIG. 1: point (X)) is caused to fall in the range of from 0.5 to 1.5 times as much as drawing speed (v) (m/min) of a running filament tow.

Figure 6:
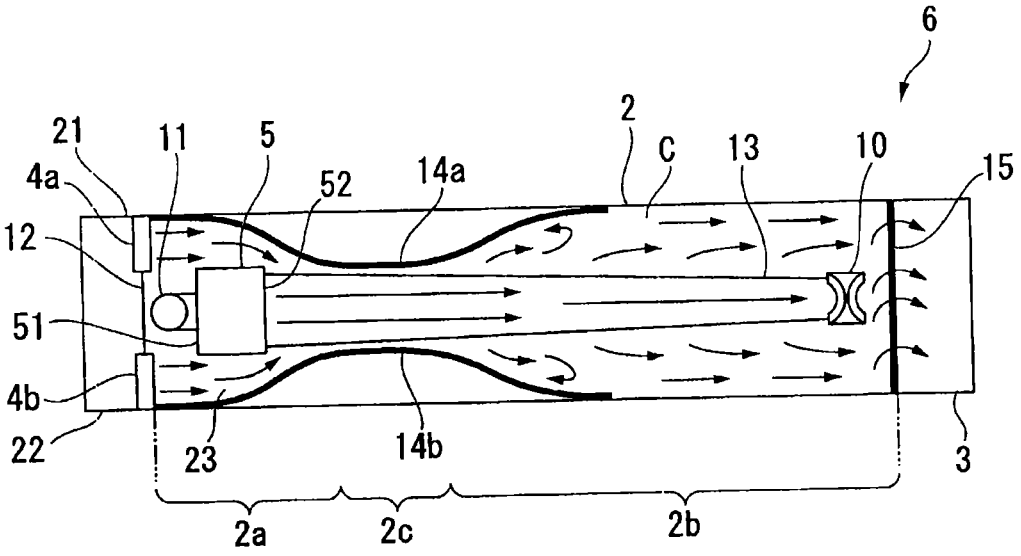
FIG. 6: A schematic plan view showing an outline constitution of another embodiment of the wet spinning apparatus of the present invention.

Note that the wet spinning apparatus of the present invention is not limited to the wet spinning apparatus shown in FIGS. 1 to 5. For example, it is not necessary that the rectifying plates are formed up to the other end (the spinning bath outlet port (15)) of the spinning bath (2) as long as they can suppress counter flow or stagnation of the coagulation liquid, and the wet spinning apparatus may be a wet spinning apparatus (6) in which the rectifying plates (14*a*) and (14*b*) are brought into contact with spinning bath side boards (21) and (22), respectively, at the middle part of the filament running portion (2*b*) as shown in FIG. 6).

In addition, the number of the rectifying plate is not limited to two as opposed to the wet spinning apparatus (1), and for example, one rectifying plate composed of a bottom plate and side boards standing up at both ends of the bottom plate may be available.

Figure 7:
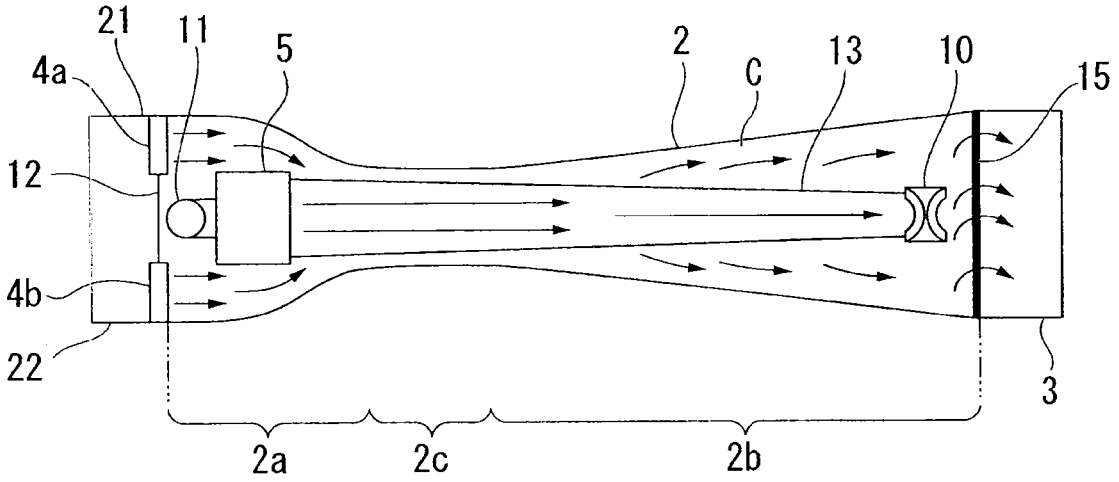
FIG. 7: A schematic plan view showing an outline constitution of another embodiment of the wet spinning apparatus of the present invention.

In addition, the wet spinning apparatus of the present invention may be one in which the coagulation bath portion (2*a*) and the filament running portion (2*b*) are formed by adjustment of the space between the spinning bath side boards (21) and (22) in the spinning bath (2) without using the rectifying plates (14*a*) and (14*b*), as shown in FIG. 7), if the coagulation bath portion (2*a*) in which the cross sectional area is gradually reduced from one end to the other end and the filament running portion (2*b*) in which the cross sectional area is gradually enlarged from one end to the other end can be formed. Note that it is preferable to use the rectifying plates as in the wet spinning apparatus (1), because it is possible to use a conventional wet spinning apparatus and it is easy to adjust the shape of the coagulation bath portion (2*a*) and the filament running portion (2*b*).

EXAMPLES

Hereinafter, the present invention will be explained in more detail with reference to Examples and Comparative Examples. Note that the present invention is not limited by the following description.

<Preparation of Spinning Raw Liquid>

Acrylonitrile, acrylamide, and methacrylic acid were copolymerized by aqueous suspension polymerization in the presence of ammonium persulfate-ammonium bisulfite and iron sulfate and an acrylonitrile polymer composed of acrylonitrile units, acrylamide, and methacrylic acid units in a ratio of 96, 3, and 1 (% by mass ratio), respectively, was obtained. This acrylonitrile polymer was dissolved in dimethylacetamide and 21% by mass spinning raw liquid A was prepared.

Example 1

The coagulation liquid (C) was adjusted in such a way that 90 mm as (L1), 90 mm as (L2), 195 mm as (L3) (a length 1.5 times as much as (z)), 80 mm as (L4), 26,520 $mm^2$ as the maximum cross sectional area in the coagulation bath portion, 26,520 $mm^2$ as the maximum cross sectional area in the filament running portion, and 17,550 $mm^2$ as the cross sectional area at the joint portion were adopted in the wet spinning apparatus (1) shown in FIGS. 1 to 5 and a flow rate at the point (X) in the joint portion was set to 7.2 m/min (a flow rate 0.9 times as much as (v)).

Spinning raw liquid (A) was discharged through the spinneret (52) having 24,000 pores with pore diameter of 45 μm into the coagulation liquid (C) composed of an aqueous dimethylacetamide solution having a concentration of 60% by mass and a temperature of 35° C. and wet spinning was carried out. The coagulated filaments (13) coagulated by the coagulation liquid (C) were drawn at a speed 0.27 times as much as a linear velocity of discharging the spinning raw liquid.

The spinneret device used had the following dimension: a nozzle width, (x), of 80 mm (FIG. 3); a nozzle thickness, (y), of 50 mm (FIG. 1); and a nozzle height, (z), of 130 mm (FIG. 1).

Then, these fibers (the coagulated filaments) were subjected to washing and 5-fold stretching at the same time, and introduced into the first oil bath storing an amino-silicone oil agent prepared at 1.5% by mass and the first oil agent was given, and then the resulting fibers were dried by heat rolls and were subjected to 2.0-fold dry heat secondary stretching between the heat rolls. Subsequently, moisture percentage of the fibers was adjusted by a touch roll and a carbon fiber precursor having a single fiber diameter of 1.2 dtex was drawn up by a winder.

Examples 2 to 5

Figure 2B:
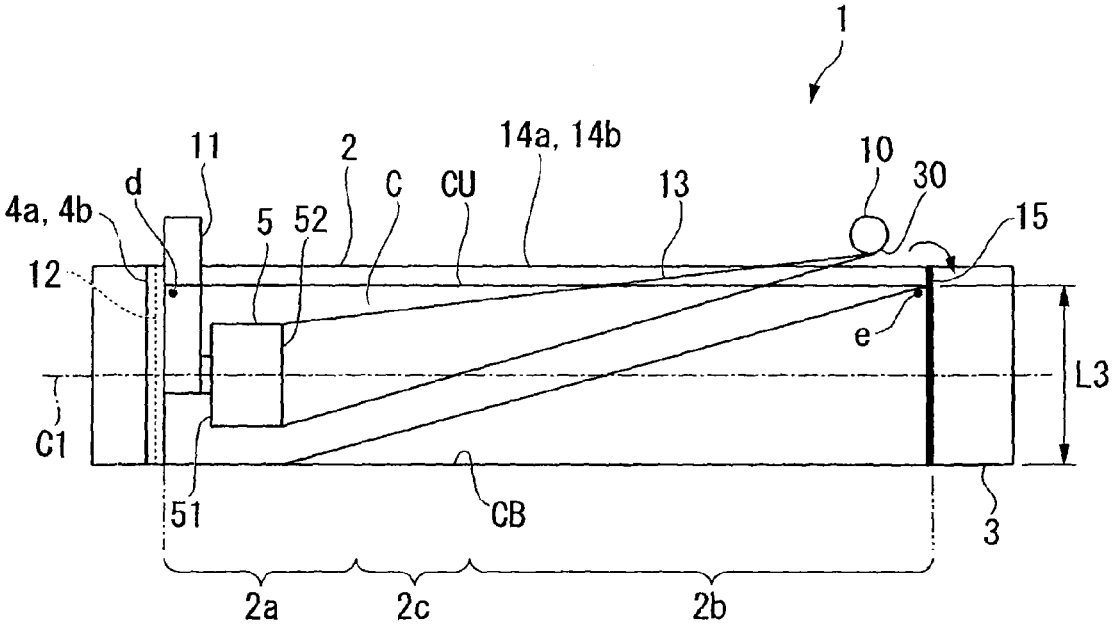
FIG. 2B: A schematic side view showing an inclined plate in the wet spinning apparatus of FIG. 1.
Figure 3:
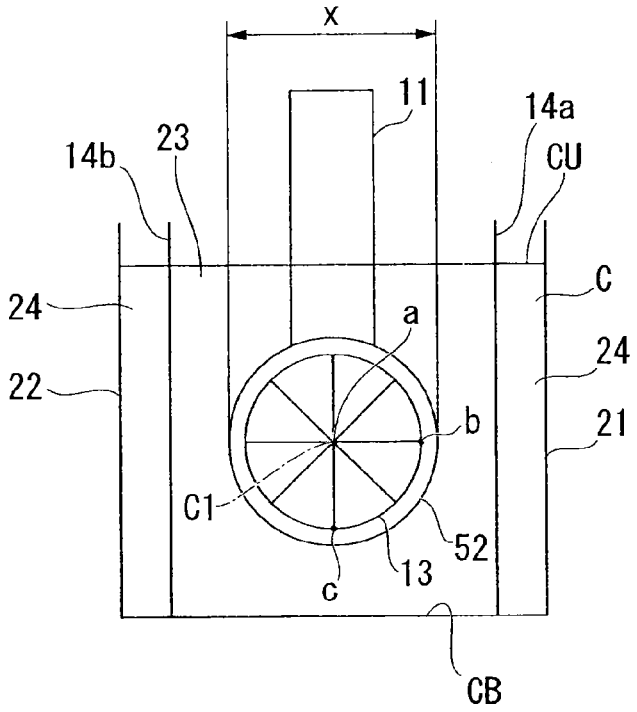
FIG. 3: A schematic sectional view along X-X line of the wet spinning apparatus of FIG. 1.
Figure 4:
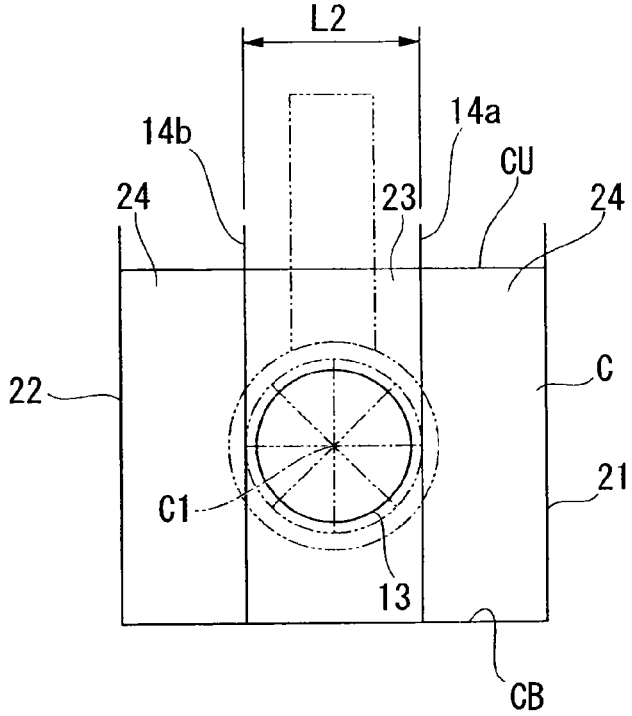
FIG. 4: A schematic sectional view along Y-Y line of the wet spinning apparatus of FIG. 1.

In each of Examples 2 to 5, the same procedure as in Example 1 was carried out except that the maximum cross sectional area (S1) in the coagulation bath portion, the maximum cross sectional area (S3) in the filament running portion, and the cross sectional area (S2) at the joint portion in the wet spinning apparatus (1) shown in FIG. 2B were changed as shown in Tables 1 and 2 and carbon fiber precursor was obtained.

Example 6

The coagulation liquid (C) was adjusted in such a way that 110 mm as (L1), 145 mm as (L2), 252 mm as (L3) (a length 1.8 times as much as (z)), 60,480 $mm^2$ as the maximum cross sectional area in the coagulation bath portion, 36,540 $mm^2$ as the maximum cross sectional area in the filament running portion, and 60,480 $mm^2$ as the cross sectional area at the joint portion were adopted in the wet spinning apparatus (1) shown in FIGS. 1 to 5 and a flow rate at the point (X) in the joint portion was set to 9.6 m/min (a flow rate 1.2 times as much as (v)).

Spinning raw liquid (A) was discharged through the spinneret (52) having 24,000 pores with pore diameter of 45 μm into the coagulation liquid (C) composed of an aqueous dimethylacetamide solution having a concentration of 60% by mass and a temperature of 35° C. and wet spinning was carried out. The coagulated filaments (13) coagulated by the coagulation liquid (C) were drawn at a speed 0.27 times as much as a linear velocity of discharging the spinning raw liquid.

The spinneret device used had the following dimension: (x) of 140 mm; (y) of 70 mm; and (z) of 140 mm (FIG. 1).

Then, these fibers (the coagulated filament) were subjected to washing and 5-fold stretching at the same time, and introduced into the first oil bath storing an amino-silicone oil agent prepared at a concentration of 1.5% by mass and the first oil agent was applied, and then the resulting fibers were dried by heat rolls and were subjected to 2.0-fold dry heat secondary stretching between the heat rolls. Subsequently, moisture percentage of the fibers was adjusted by a touch roll and a carbon fiber precursor having a single fiber diameter of 1.2 dtex was drawn up by a winder.

Example 7

The same procedure as in Example 1 was carried out except that a wet spinning apparatus shown in FIG. 6 was used and carbon fiber precursor was obtained.

Examples 8 and 9

In each of Examples 8 and 9, the same procedure as in Example 1 was carried out except that (L4) was changed a shown in Tables 1 and 2 in the wet spinning apparatus (1) shown in FIGS. 1 to 5 and carbon fiber precursor was obtained.

Example 10

The same procedure as in Example 1 was carried out except that (L3) was changed to 299 mm (a length 2.3 times as much as (z)) in the wet spinning apparatus (1) shown in FIGS. 1 to 5 and carbon fiber precursor was obtained.

Comparative Example 1

Figure 8:
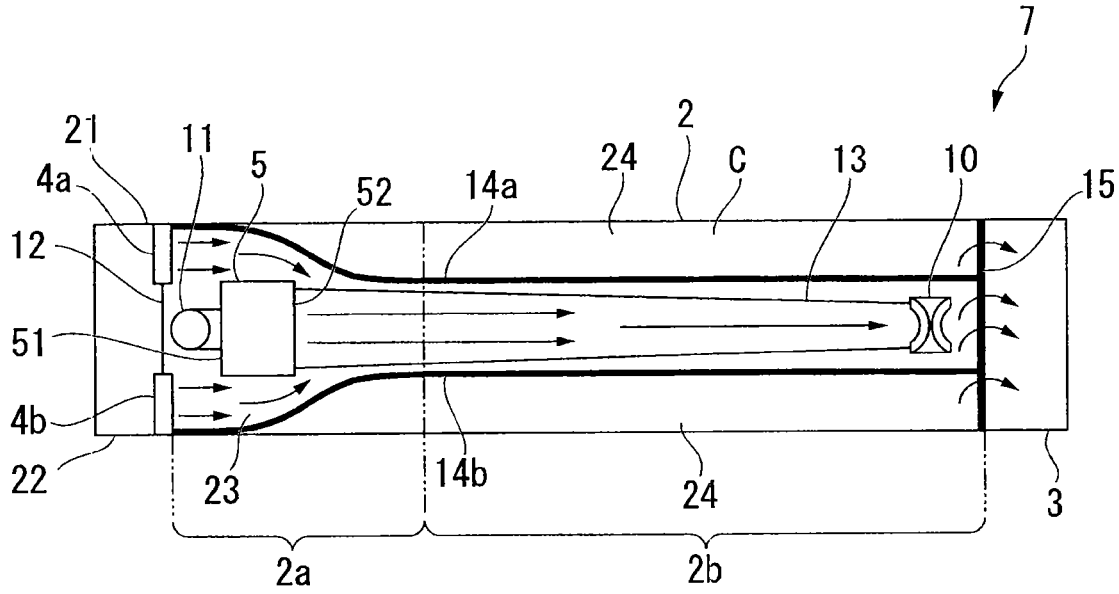
FIG. 8: A schematic plan view showing an outline constitution of the wet spinning apparatus of Comparative Example 1.

The same procedure as in Example 1 was carried out except that a wet spinning apparatus shown in FIG. 8 was used and carbon fiber precursor was obtained.

Comparative Example 2

Figure 9:
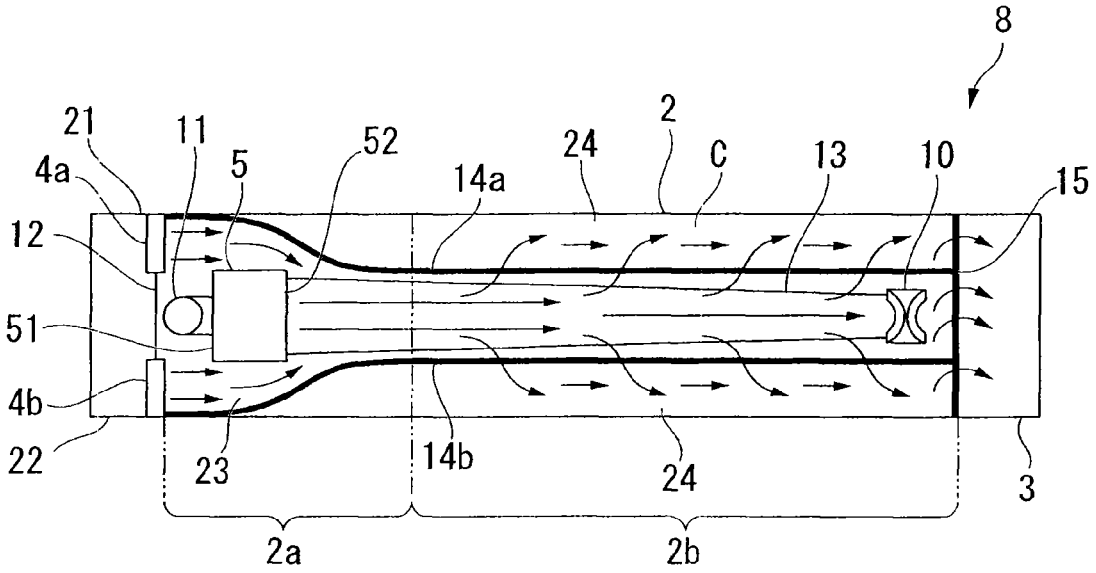
FIG. 9: A schematic plan view showing an outline constitution of the wet spinning apparatus of Comparative Example 2.
Figure 10:
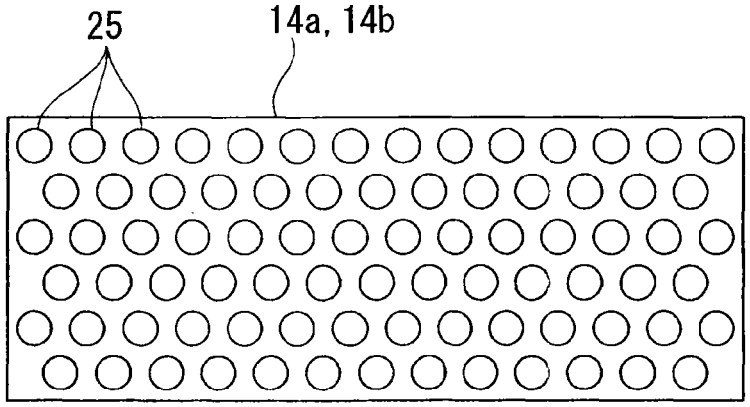
FIG. 10: A schematic view showing a side shape of the rectifying plate in the wet spinning apparatus of Comparative Example 2.

The same procedure as in Example 1 was carried out except that a wet spinning apparatus shown in FIG. 9 was used and carbon fiber precursor was obtained.

Comparative Example 3

Figure 11:
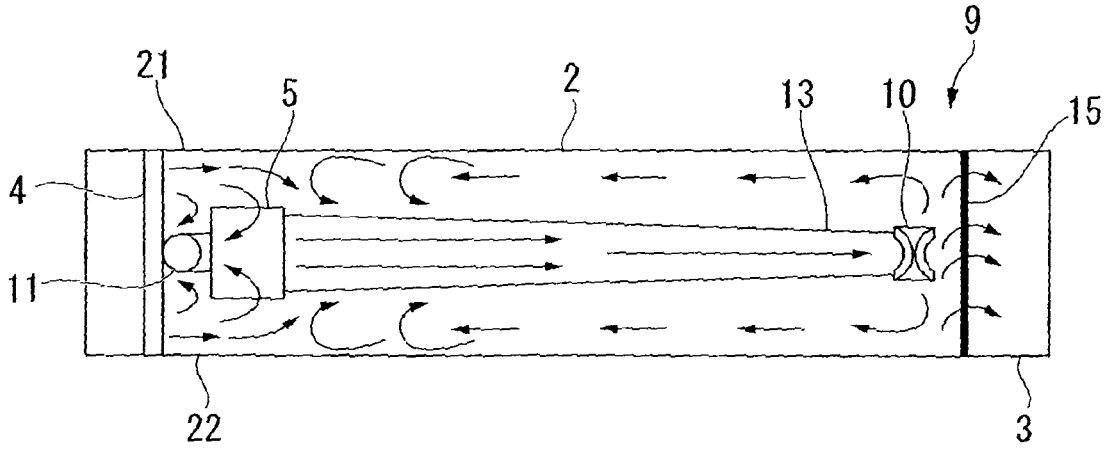
FIG. 11: A schematic plan view showing an outline constitution of the wet spinning apparatus of Comparative Example 3.

The same procedure as in Example 1 was carried out except that a wet spinning apparatus shown in FIG. 11 was used and carbon fiber precursor was obtained.

Comparative Example 4

The same procedure as in Example 1 was carried out except that a flow rate of the coagulation liquid (C) at the point (X) in the joint portion in the wet spinning apparatus (1) shown in FIGS. 1 to 5 was set to 3.2 m/min (a flow rate 0.4 times as much as (v)) and carbon fiber precursor was obtained.

Comparative Example 5

The same procedure as in Example 1 was carried out except that a flow rate of the coagulation liquid (C) at the point (X) in the joint portion in the wet spinning apparatus (1) shown in FIGS. 1 to 5 was set to 14.4 m/min (a flow rate 1.8 times as much as (v)) and carbon fiber precursor was obtained.

Example 11

The same procedure as in Example 1 was carried out except that 54,600 $mm^2$ as the maximum cross sectional area (S1) in the coagulation bath portion, 54,600 $mm^2$ as the maximum cross sectional area (S3) in the filament running portion, and 9,750 $mm^2$ as the cross sectional area (S2) at the joint portion were adopted in the wet spinning apparatus (1) shown in FIGS. 1 to 5 and carbon fiber precursor was obtained.

Comparative Example 6 and Examples 12 to 15

In each of Comparative Example 6 and Examples 12 to 15, the same procedure as in Example 1 was carried out except that the maximum cross sectional area (S1) in the coagulation bath portion, the maximum cross sectional area (S3) in the filament running portion, and the cross sectional area (S2) at the joint portion in the wet spinning apparatus (1) shown in FIG. 2B were changed as shown in Tables 1 and 2 and carbon fiber precursor was obtained.

TABLE 1

| | | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|---|
| Nozzle shape | | Square | Square | Square | Square | Square | Round | Square | Square | Square | Square |
| Nozzle size | x (mm) | 80 | 80 | 80 | 80 | 80 | 140 | 80 | 80 | 80 | 80 |
| | y (mm) | 50 | 50 | 50 | 50 | 50 | 70 | 50 | 50 | 50 | 50 |
| | z (mm) | 130 | 130 | 130 | 130 | 130 | 140 | 130 | 130 | 130 | 130 |
| Specification of wet spinning apparatus | L1 | 90 | 90 | 90 | 90 | 90 | 110 | 90 | 90 | 90 | 90 |
| | L2 | 90 | 90 | 80 | 80 | 80 | 145 | 90 | 90 | 90 | 90 |
| | L3 | 195 | 195 | 195 | 195 | 195 | 252 | 195 | 195 | 195 | 299 |
| | | 1.5 times z | 1.5 times z | 1.5 times z | 1.5 times z | 1.5 times z | 1.8 times z | 1.5 times z | 1.5 times z | 1.5 times z | 2.3 times z |
| | L4 | 80 | 80 | 80 | 80 | 80 | 80 | 80 | 30 | 220 | 80 |
| | S1 | 26520 | 35100 | 35100 | 19500 | 39000 | 60480 | 26520 | 26520 | 26520 | 40664 |
| | S2 | 17550 | 12150 | 11200 | 12400 | 8000 | 36540 | 17550 | 17550 | 17550 | 26910 |
| | S3 | 26520 | 20700 | 53900 | 53475 | 12600 | 60480 | 26520 | 26520 | 26520 | 40664 |
| | S1/S2 | 1.51 | 2.89 | 3.13 | 1.57 | 4.88 | 1.66 | 1.51 | 1.51 | 1.51 | 1.51 |
| | S3/S2 | 1.51 | 1.70 | 4.81 | 4.31 | 1.58 | 1.66 | 1.51 | 1.51 | 1.51 | 1.51 |
| Drawing speed of coagulating filaments (m/min) | | 8.0 | 8.0 | 8.0 | 8.0 | 8.0 | 8.0 | 8.0 | 8.0 | 8.0 | 8.0 |
| Flow rate at point X (m/min) | | 7.2 (0.9 times v) | 7.2 (0.9 times v) | 7.2 (0.9 times v) | 7.2 (0.9 times v) | 7.2 (0.9 times v) | 9.6 (1.2 times v) | 7.2 (0.9 times v) | 7.2 (0.9 times v) | 7.2 (0.9 times v) | 7.2 (0.9 times v) |
| Existence of rectifying plates | | Yes | Yes | Yes | Yes | Yes | Yes | Yes | Yes | Yes | Yes |
| Shape of openings on the rectifying plates | | None | None | None | None | None | None | None | None | None | None |
| Shape of inner bath | | FIG. 1 | FIG. 1 | FIG. 1 | FIG. 1 | FIG. 1 | FIG. 1 | FIG. 6 | FIG. 1 | FIG. 1 | FIG. 1 |

TABLE 2

| | | Comp. Ex. 1 | Comp. Ex. 2 | Comp. Ex. 3 | Ex. 11 | Ex. 12 | Ex. 13 | Comp. Ex. 4 | Ex. 14 | Ex. 15 | Ex. 16 | Ex. 17 |
|---|---|---|---|---|---|---|---|---|---|---|---|---|
| Nozzle shape | | Square | Square | Square | Square | Square | Square | Square | Square | Square | Square | Square |
| Nozzle size | x (mm) | 80 | 80 | 80 | 80 | 80 | 80 | 80 | 80 | 80 | 80 | 80 |
| | y (mm) | 50 | 50 | 50 | 50 | 50 | 50 | 50 | 50 | 50 | 50 | 50 |
| | z (mm) | 130 | 130 | 130 | 130 | 130 | 130 | 130 | 130 | 130 | 130 | 130 |
| Specification of wet spinning apparatus | L1 | 90 | 90 | — | 90 | 90 | 90 | 90 | 90 | 90 | 90 | 90 |
| | L2 | 90 | 90 | — | 90 | 90 | 50 | 90 | 90 | 80 | 80 | 80 |
| | L3 | 195 | 195 | 195 | 195 | 195 | 195 | 195 | 195 | 195 | 195 | 195 |
| | | 1.5 times z | 1.5 times z | 1.5 times z | 1.5 times z | 1.5 times z | 1.5 times z | 1.5 times z | 1.5 times z | 1.5 times z | 1.5 times z | 1.5 times z |
| | L4 | 80 | 80 | — | 80 | 80 | 80 | 80 | 80 | 80 | 80 | 80 |
| | S1 | 26520 | 26520 | — | 26520 | 26520 | 54600 | 26520 | 35100 | 35100 | 17550 | 40950 |
| | S2 | 17550 | 17550 | — | 17550 | 17550 | 9750 | 13410 | 12150 | 11200 | 12400 | 8000 |
| | S3 | 17550 | 17550 | — | 26520 | 26520 | 54600 | 10880 | 17100 | 62300 | 53475 | 12600 |
| | S1/S2 | 1.51 | 1.51 | — | 1.51 | 1.51 | 5.60 | 1.98 | 2.89 | 3.13 | 1.42 | 5.12 |
| | S3/S2 | 1.00 | 1.00 | — | 1.51 | 1.51 | 5.60 | 0.81 | 1.41 | 5.56 | 4.31 | 1.58 |
| Drawing speed of coagulating filaments (m/min) | | 8.0 | 8.0 | 8.0 | 8.0 | 8.0 | 8.0 | 8.0 | 8.0 | 8.0 | 8.0 | 8.0 |
| Flow rate at point X (m/min) | | 7.2 (0.9 times v) | 7.2 (0.9 times v) | 7.2 (0.9 times v) | 3.2 (0.4 times v) | 14.4 (1.8 times v) | 7.2 (0.9 times v) | 7.2 (0.9 times v) | 7.2 (0.9 times v) | 7.2 (0.9 times v) | 7.2 (0.9 times v) | 7.2 (0.9 times v) |
| Existence of rectifying plates | | Yes | Yes | No | Yes | Yes | Yes | Yes | Yes | Yes | Yes | Yes |
| Shape of openings on the rectifying plates | | None | Multiple pores by punching | — | None | None | None | None | None | None | None | None |
| Shape of inner bath | | FIG. 8 | FIG. 9 | FIG. 11 | FIG. 1 | FIG. 1 | FIG. 1 | FIG. 2B | FIG. 1 | FIG. 1 | FIG. 1 | FIG. 1 |

<Evaluation Method>

In Examples and Comparative Examples, the following evaluations were carried out: flow state of the coagulation liquid, existence of stagnation, and evaluation of concentration and temperature; and shape of cross sectional area of a single fiber, number of single fibers adhering each other, and draw rate at break, all with respect to a carbon fiber precursor obtained.

(Flow State of the Coagulation Liquid)

DI water was dropped in the spinning bath (2) and flow state thereof was confirmed by visual inspection.

(Existence of Stagnation)

Whether or not there is any stagnation in the spinning bath (2) was confirmed by visual inspection.

(Measurement of Concentration and Temperature)

Five milliliter of the coagulation liquid (C) was taken with a syringe at each spot of 3 spots on the surface of the spinneret (52) (a, b, and c in FIG. 3), a spot near the liquid surface (CU) at one end of the coagulation bath portion (2*a*) (d in FIG. 2A), and a spot near the liquid surface (CU) at the other end of the filament running portion (2*b*) (e in FIG. 2A), and concentration thereof was measured with a refractometer (trade name RA-520, manufactured by Kyoto Electronics Manufacturing Co., Ltd.). In addition, temperature was measured at the same spots with a mercury thermometer.

(Shape of Cross Sectional Area of a Single Fiber)

The carbon fiber precursor obtained was inserted into a tube having an internal diameter of 1 mm and made of a vinyl chloride resin, and then the resulting tube was cut in a round slice with a knife and a sample was prepared. Then the sample was sticked on a SEM sample holder with the cross sectional area of the fibers being faced upward, Au was coated thereon to the thickness of about 10 nm by sputter coating, and the cross sectional area of a single fiber was observed with a scanning electron microscope (trade name XL20, manufactured by Royal Philips Electronics) at conditions of an acceleration voltage of 7.00 kV and a working distance of 31 mm. A longitudinal length and a transverse length of the cross sectional area of the single fiber were measured and the ratio of the longitudinal length to the transverse length was obtained. In addition, a variation rate (CV value) was calculated from measurements of the ratio of the longitudinal length to the transverse length on single fibers based on n=400.

(Number of Single Fibers Adhering Each Other)

Judgment of the number of single fibers adhering each other was carried out in such a way that the carbon fiber precursor drawn up was cut in about 5 mm, dispersed in 100 mL of water, stirred for 1 minute at 100 rpm, filtered by a black filter paper, and the number of single fibers adhering each other was measured.

(Draw Rate at Break)

A drawing speed of the coagulated filaments which is 0.45 times as much as a linear velocity of discharging the spinning raw liquid is determined as a standard drawing speed. A drawing speed of the coagulated filaments at the time when the coagulated filaments break at the surface for discharging of the nozzle as the drawing speed of the coagulated filaments is increasingly raised while the linear velocity of discharging the spinning raw liquid is not changed is determined as a drawing speed at break. Draw rate at break is calculated from the standard drawing speed and the drawing speed at break in accordance with the following equation.

(draw rate at break)=(drawing speed at break)/(standard drawing speed)

The evaluation results in Examples and Comparative Examples are shown in Tables 3 and 4. Note that concentrations and temperatures in Tables 3 and 4 are those based on standards of a concentration of 60% by mass and a temperature of 35° C.

(Comprehensive Evaluation)

The results of the flow state of the coagulation liquid, existence of stagnation, measurements of concentration and temperature, shape of cross sectional area of a single fiber, number of single fibers adhering each other, scale factor for break in drawing, and amount of nest caught on the rectifying plates were comprehensively evaluated in accordance with the following criteria.

○: Very good

Δ: Good

X: Bad

TABLE 3

| | | | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|---|---|
| Flow state of coagulation liquid (visual inspection) | | | Homo* (FIG. 1 See arrow) | Homo* | Homo* | Homo* | Homo* | Homo* (FIG. 1 See arrow) | Partially turbulent flow (FIG. 6 See arrow) | Turb* | Turb* | Turb* |
| Whether or not there is any stagnation (visual inspection) | | | No | No | No | No | No | No | Partially Yes | Yes | Yes | Yes |
| Turbulence of coagulating filaments (tow) | | | No | No | No | No | No | No | No | Yes | Yes | Yes |
| Amount of nest caught on the rectifying plates | | | 0 g | 0 g | 0 g | 0 g | 0 g | 0 g | 0 g | 0 g | 0 g | 0 g |
| Surface of spinning mouth piece | a | Conc. (%) | +0.2 | +0.3 | +0.3 | +0.2 | +0.2 | +0.2 | +0.2 | +2.1 | +4.0 | +5.7 |
| | | Temp. (° C.) | +0.1 | +0.1 | +0.2 | +0.1 | +0.1 | +0.0 | +0.0 | +1.1 | +2.2 | +3.1 |
| | b | Conc. (%) | +0.2 | +0.3 | +0.5 | +0.2 | +0.2 | +0.2 | +0.2 | +1.5 | +4.9 | +5.0 |
| | | Temp. (° C.) | +0.1 | +0.1 | +0.2 | +0.1 | +0.1 | +0.1 | +0.0 | +0.9 | +2.9 | +3.0 |
| | c | Conc. (%) | +0.1 | +0.2 | +0.3 | +0.1 | +0.1 | +0.1 | +0.1 | +1.5 | +4.8 | +5.0 |
| | | Temp. (° C.) | +0.3 | +0.3 | +0.3 | +0.3 | +0.3 | +0.2 | +0.2 | +0.9 | +3.1 | +2.9 |
| One end part of spinning bath | d | Conc. (%) | +0.2 | +0.2 | +0.3 | +0.2 | +0.2 | +0.2 | +0.2 | +0.2 | +2.7 | +4.4 |
| | | Temp. (° C.) | +0.1 | +0.1 | +0.4 | +0.1 | +0.1 | +0.2 | +0.1 | +0.2 | +2.8 | +2.7 |
| The other end part of spinning bath | e | Conc. (%) | +1.7 | +1.5 | +1.8 | +1.7 | +1.7 | +1.8 | +1.8 | +1.7 | +8.9 | +7.7 |
| | | Temp. (° C.) | +0.8 | +0.3 | +0.7 | +0.8 | +0.8 | +0.5 | +0.9 | +0.8 | +8.0 | +6.5 |
| Shape of cross sectional area of a single fiber | Ratio of long axis/short axis | | 1.43 | 1.33 | 1.32 | 1.43 | 1.43 | 1.45 | 1.44 | 1.43 | 1.44 | 1.38 |
| | CV value (%) | | 8.80 | 7.66 | 9.00 | 8.80 | 8.80 | 7.93 | 9.10 | 14.40 | 15.20 | 16.52 |
| Number of single fibers adhering each other (number) | | | 2 | 3 | 3 | 2 | 2 | 2 | 0 | 11 | 12 | 8 |
| Scale factor for break in drawing | | | 2.41 | 2.56 | 2.23 | 2.41 | 2.41 | 2.39 | 2.44 | 1.98 | 2.01 | 1.79 |
| Comprehensive evaluation | | | ○ | ○ | ○ | ○ | ○ | ○ | ○ | Δ | Δ | Δ |

Abbreviation:

Homo* = Homogeneous in a constant direction;

Turb* = Turbulent flow was found/inhomogeneous

TABLE 4

| | | | Comp. Ex. 1 | Comp. Ex. 2 | Comp. Ex. 3 | Ex. 11 | Ex. 12 | Ex. 13 | Comp. Ex. 4 | Ex. 14 | Ex. 15 | Ex. 16 | Ex. 17 |
|---|---|---|---|---|---|---|---|---|---|---|---|---|---|
| Flow state of coagulation liquid (visual inspection) | | | Homo* (FIG. 8 See arrow) | Homo* (FIG. 9 See arrow) | Turb* (FIG. 11 See arrow) | Turb* | Turb* | Turb* | Turb* | Turb* | Turb* | Turb* | Turb* |
| Whether or not there is any stagnation (visual inspection) | | | No | No | Yes | Yes | Yes | Yes | Yes | Yes | Yes | Yes | Yes |
| Turbulence of coagulating filaments (tow) | | | Imp-Spin* | No | Yes | No | Imp-Spin* | Yes | Yes | Yes | No | Yes | Yes |
| Amount of nest caught on the rectifying plates | | | 0 g | 1.95 g*2 | — | 0 g | 0 g | 0 g | 0 g | 0 g | 0 g | 0 g | 0 g |
| Surface of spinninig mouth piece | a | Conc. (%) | +0.2 | +0.2 | +5.5 | +6.7 | +0.2 | +5.1 | +0.2 | +0.3 | +0.3 | +4.4 | +2.3 |
| | | Temp. (° C.) | +0.2 | +0.1 | +2.2 | +2.5 | +0.1 | +2.2 | +0.2 | +0.1 | +0.2 | +3.8 | +1.5 |
| | b | Conc. (%) | +0.3 | +0.2 | +5.7 | +5.1 | +0.2 | +5.3 | +0.3 | +0.3 | +0.5 | +5.2 | +1.9 |
| | | Temp. (° C.) | +0.1 | +0.0 | +2.7 | +2.6 | +0.0 | +2.3 | +0.1 | +0.1 | +0.2 | +3.7 | +1.1 |
| | c | Conc. (%) | +0.2 | +0.3 | +5.5 | +5.7 | +0.2 | +5.1 | +0.2 | +0.2 | +0.3 | +4.4 | +1.8 |
| | | Temp. (° C.) | +0.0 | +0.1 | +2.1 | +2.4 | +0.1 | +2.1 | +0.0 | +0.3 | +0.3 | +3.7 | +1.2 |
| One end part of spinning bath | d | Conc. (%) | +0.2 | +0.2 | +2.8 | +2.6 | +0.2 | +2.8 | +0.2 | +3.2 | +0.3 | +0.2 | +4.4 |
| | | Temp. (° C.) | +0.2 | +0.0 | +1.3 | +2.2 | +0.0 | +1.1 | +0.2 | +2.9 | +0.4 | +0.1 | +2.7 |
| The other end part of spinning bath | e | Conc.(%) | +0.9 | +1.8 | +9.2 | +10.1 | +1.1 | +9.2 | +0.9 | +4.4 | +8.0 | +4.4 | +1.8 |
| | | Temp. (° C.) | +0.3 | +1.0 | +12.0 | +14.2 | +0.9 | +12.4 | +0.3 | +5.9 | +5.5 | +3.3 | +0.8 |
| Shape of cross sectional area of a single fiber | | Ratio of long axis/short axis | Imp-Samp* | 1.43 | 1.21 | 1.19 | Imp-Samp* | 1.21 | Imp-Samp* | 1.29 | 1.34 | 1.33 | 1.40 |
| | | CV value (%) | Imp-Samp* | 8.90 | 12.30 | 14.40 | Imp-Samp* | 12.70 | Imp-Samp* | 12.10 | 9.89 | 13.30 | 12.20 |
| Number of single fibers adhering each other (number) | | | Imp-Samp* | 2 | 9 | 12 | Imp-Samp* | 9 | Imp Samp* | 8 | 12 | 9 | 10 |
| Scale factor for break in drawing | | | Imp-Eval* | 2.41 | 1.98 | 1.82 | Imp-Eval* | 1.98 | Imp-Eval* | 2.01 | 2.00 | 1.88 | 1.88 |
| Comprehensive evaluation | | | X | X | X | X | X | Δ | X | Δ | Δ | Δ | Δ |

Abbreviation:
Homo* = Homogeneous in a constant direction;
Turb* = Turbulent flow was found/inhomogeneous;
Imp-Spin* = Stable spinning impossible
Imp-Samp* = Sampling Impossible;
Imp-Eval* = Evaluation impossible;
*2= continuous operation impossible;

As shown in Tables 3 and 4, in Examples 1 to 6 in which the wet spinning apparatus (1) of the present invention was used, temperature and concentration of the coagulation liquid (C) in the spinning bath (2) were homogenized and counter flow or stagnation of the coagulation liquid was not found. In addition, filament waste (nest) did not stick to the rectifying plates and a carbon fiber precursor with excellent quality was stably obtained. The comprehensive evaluation thereof was very good.

In addition, in Examples 7, temperature and concentration of the coagulation liquid (C) were homogenized in the spinning bath (2), though counter flow or stagnation of the coagulation liquid was partly found, and filament waste (nest) did not stick to the rectifying plates and a carbon fiber precursor with excellent quality was stably obtained. The comprehensive evaluation thereof was very good.

On the other hand, in each of Examples 8 to 10, length (L4) at the joint portion, (L3) (liquid depth) relative to the nozzle size ((x), (y), and (z)), or device specification for the coagulation bath portion was improper, so that concentration and temperature at the nozzle surface became inhomogeneous and replacement efficiency of the coagulation liquid became bad. In addition, although inhomogeneity such as turbulent flow or stagnation was found in the visual inspection of the flow state of the coagulation liquid flow, the comprehensive evaluations thereof were good.

In Comparative Example 1, the flow rate of the coagulation liquid (C) at the other end of the spinning bath (2) became too fast, so that the accompanying flow of the coagulation liquid (C) caused turbulence in the tow (the coagulated filament) and break of a single fiber when the tow (the coagulated filament) was drawn through the drawing roll (10), so that stable spinning was impossible and the sample for evaluation could not be obtained, though concentration and temperature of the coagulation liquid (C) were measured. The comprehensive evaluation was bad.

In Comparative Example 2, broken filament waste (nest) from the nozzle (5) got caught at openings 25 formed on the rectifying plates (14*a*) and (14*b*), so that the openings (25) were clogged by the filament waste and thus stable production was difficult. In addition, contamination of the filament waste (nest) was recognized in the carbon fiber precursor thus obtained and the comprehensive evaluation was bad.

In Comparative Example 3, the flow of the coagulation liquid (C) became inhomogeneous owing to a constant cross sectional area of the spinning bath, and thereby inhomogeneity in the concentration and temperature of the coagulation liquid (C) was caused, and thus a carbon fiber precursor poor in quality was obtained and the comprehensive evaluation was bad.

In Comparative Example 4, the flow of the coagulation liquid (C) became inhomogeneous because the flow rate of the coagulation liquid (C) at the contact point of the coagulation bath portion and the filament running portion, the point (X), was slow, though the wet spinning apparatus (1) of the present invention was used, and thereby inhomogeneity in the concentration and temperature of the coagulation liquid (C)

was caused, and thus a carbon fiber precursor poor in quality was obtained and the comprehensive evaluation was bad.

In Comparative Example 5, the flow rate of the coagulation liquid (C) at the contact point of the coagulation bath portion and the filament running portion, the point (X), became fast, though the wet spinning apparatus (1) of the present invention was used, and thus the accompanying flow generated near the nozzle caused break of a single fiber, so that stable spinning was impossible and samples of carbon fiber precursor for evaluation could not be obtained, though concentration and temperature of the coagulation liquid (C) were measured. The comprehensive evaluation was bad.

In Example 11, the maximum cross sectional area (S1) in the coagulation bath portion and the maximum cross sectional area (S3) in the filament running portion were large relative to the cross sectional area (S2) at the joint portion, though the wet spinning apparatus (1) of the present invention was used, and thus the flow of the coagulation liquid (C) around the coagulation bath portion and the filament running portion became inhomogeneous, and thereby inhomogeneity in the concentration and temperature of the coagulation liquid (C) was caused, and thus a carbon fiber precursor poor in quality was obtained and the comprehensive evaluation was good.

In Comparative Example 6, the maximum cross sectional area (S3) in the filament running portion became too small relative to the cross sectional area (S2) at the joint portion, though the wet spinning apparatus (1) of the present invention was used, and hence the flow rate of the coagulation liquid (C) at the other end of the spinning bath (2) became too fast, and thus the accompanying flow of the coagulation liquid (C) caused turbulence in the tow (the coagulated filaments) and break of a single fiber when the tow (the coagulated filaments) was drawn through the drawing roll (10), so that stable spinning was impossible and samples for evaluation could not be obtained, though concentration and temperature of the coagulation liquid (C) were measured. The comprehensive evaluation was bad.

In Example 12, the maximum cross sectional area (S3) in the filament running portion became too small relative to the cross sectional area (S2) at the joint portion, though the wet spinning apparatus (1) of the present invention was used, and hence the flow rate of the coagulation liquid (C) at the other end of the spinning bath (2) became somewhat fast, and thus the accompanying flow of the coagulation liquid (C) caused turbulence in the tow (the coagulated filaments) when the tow (the coagulated filaments) was drawn through the drawing roll (10) and also caused inhomogeneity in the concentration and temperature of the coagulation liquid (C), and thus a carbon fiber precursor poor in quality was obtained and the comprehensive evaluation was good.

In Example 13, the maximum cross sectional area (S3) in the filament running portion was too large, though the wet spinning apparatus (1) of the present invention was used, and thus the flow of the coagulation liquid (C) around the coagulation bath portion and the filament running portion became inhomogeneous, and thereby inhomogeneity in the concentration and temperature of the coagulation liquid (C) was caused, and thus a carbon fiber precursor poor in quality was obtained.

In Example 14, the maximum cross sectional area (S1) in the coagulation bath portion was too small, though the wet spinning apparatus (1) of the present invention was used, and thus the flow rate of the coagulation liquid (C) became slightly fast relative to the drawing speed of the coagulated filaments, and thus the flow of the coagulation liquid (C) became inhomogeneous and the concentration and temperature of the coagulation liquid (C) also became inhomogeneous, and thus a carbon fiber precursor poor in quality was obtained and the comprehensive evaluation was good.

In Example 15, the maximum cross sectional area (S1) in the coagulation bath portion was large relative to the cross sectional area (S2) at the joint portion, though the wet spinning apparatus (1) of the present invention was used, and thus the flow of the coagulation liquid (C) became inhomogeneous around the coagulation bath portion and the filament running portion, and thereby inhomogeneity in the concentration and temperature of the coagulation liquid (C) was caused, and thus a carbon fiber precursor poor in quality was obtained and the comprehensive evaluation was good.

INDUSTRIAL APPLICABILITY

The wet spinning apparatus and the method for wet spinning of the present invention enable to manufacture synthetic fibers with excellent quality by control of the flow of a coagulation liquid in a spinning bath and thus can be suitably used for wet spinning of various synthetic fibers such as carbon fiber.

The invention claimed is:

1. A method for wet spinning for synthetic fibers with a wet spinning apparatus including a spinning bath having a coagulation bath portion, a filament running portion, and a joint portion between the coagulation bath portion and the filament running portion, the method comprising:

providing a cross sectional area of the coagulation bath portion as gradually reduced from a first end to a second end of the coagulation bath portion;

providing a cross sectional area of the filament running portion as gradually enlarged from a first end to a second end of the filament running portion;

providing, at the first end of the coagulation bath portion, a bath wall including a non-porous plate and at least one port;

supplying coagulation fluid to the coagulation bath portion with the bath wall;

wet spinning the synthetic fibers using the wet spinning apparatus; and regulating a flow rate of a coagulation liquid at the joint portion to fall in a range of 0.5 to 1.5 times as much as a drawing speed of a running filament tow.

* * * * *